US005091613A

United States Patent [19]

Rohde et al.

[11] Patent Number: 5,091,613

[45] Date of Patent: Feb. 25, 1992

[54] PEDAL BOARD FOR MUSICAL INSTRUMENTS

[75] Inventors: Mark W. Rohde, Scio; Roger T. Brown; George T. Kirkwood, both of Hillsboro; Dick G. Schalk, Portland; Robert L. Smythe, Beaverton, all of Oreg.

[73] Assignee: Rodgers Instrument Corporation, Hillsboro, Oreg.

[21] Appl. No.: 494,146

[22] Filed: Mar. 14, 1990

[51] Int. Cl.[5] ..... H01H 3/14; H01H 9/26; B26D 7/06

[52] U.S. Cl. ..... 200/86.5; 200/5 A; 84/434

[58] Field of Search ..... 84/746, 721, 670, 644, 84/433, 434, 435; 200/86.5, 5 A, 5 R

[56] References Cited

U.S. PATENT DOCUMENTS

| | | | |
|---|---|---|---|
| 998,192 | 7/1911 | Mayor | 84/435 |
| 3,254,554 | 6/1966 | Nordquist | 84/434 |
| 4,490,587 | 12/1984 | Miller et al. | 200/5 A |

OTHER PUBLICATIONS

Walker Technical Company, Letter Feb. 12, 1990, 6610 Crown Lane, Zionsville, Pa. 18092.

*Primary Examiner*—Harold Broome
*Attorney, Agent, or Firm*—William A. Birdwell

[57] ABSTRACT

A pedal board for musical instruments. Pedal mounting, guide, and electrical switch mechanisms are provided in a pedal board for an electronic organ. Each pedal is mounted by a cylindrical pin attached to the back end of the pedal and to the base of the pedal board by an interference fit. A similar, guide pin is attached to the front end of the pedal by an interference fit. The guide pin fits loosely in an aperture which limits lateral movement of the pin and, thence, of the pedal itself. The lower end of the guide pin actuates an elastomeric electric switch when the pedal is pressed down. The elastomeric electric switch is mounted on a printed circuit board, and includes a chamber having a bell-shaped wall attached to a support strip by weakened edges and enclosed at the bottom by a diaphragm carrying a conductive element. The conductive element shorts contacts on the printed circuit board when the chamber is compressed by the guide pin. Pedal board tension and resiliency is provided by the mounting pin.

26 Claims, 6 Drawing Sheets

D
D
90
92
88
94
98
100
101
102
103
104
105
106
107
108
110
112
114
116
118
120
122
124
126
128

PEDAL BOARD FOR MUSICAL INSTRUMENTS

BACKGROUND OF THE INVENTION

This invention relates to pedal boards for musical instruments, and particularly to mounting, guide, and switching mechanisms for pedal boards in pipe or electronic organs.

Organs usually include, in addition to the keyboard, a pedal board comprising a plurality of pedals to be actuated by the musician's feet for producing additional notes. The usual pedal board has a spring attached to each pedal key. The purpose of this spring is to return the pedal key to the normal position after being depressed. Also, the spring adds a predetermined amount of resistance to the pedal movement. The typical springs are made of metal and may be coil, leaf or compass type. The pedal key is attached to a pivot point at one end and restricted by a guide comb at the other end. The return spring may be attached at any point from the pivot end to the free end. Each pedal key activates a switch or set of switches inside or outside the pedal board. These switches may control air pressure, vacuum or electrical current.

There are problems with the known mechanical and switching arrangements of pedals in pedal boards for organs. Ordinarily, the pedal spring tension for each pedal has to be individually adjusted when the pedal boards are assembled. The comb guide for the pedal keys is relatively difficult to fabricate. Because the spring does not tend to prevent lateral movement of the pedal key very well, the sides of the pedal key frequently strike the interior sides of the slot in the comb guide, resulting in unwanted noise.

Alignment of the various pedals and their respective switches is often a difficult problem. In addition, deterioration of the parts in such a pedal board occurs more rapidly than is desirable.

Accordingly, there is a need for a pedal board which can be more readily assembled, that reduces the number of parts, that reduces noise, that is easier to assemble, and that has a longer useful life than prior art pedal boards.

SUMMARY OF THE INVENTION

The present invention solves the aforementioned problems and provides other advantages through novel pedal mounting, guide, and switch mechanisms. Each pedal key (referred to herein simply as a pedal for convenience) in the pedal board of the present invention is mounted at one end by a mounting pin which attaches to the pedal board and to the base of the pedal board assembly. Preferably, the pin is cylindrical and made of fiberglass, though it could also be made of a variety of other materials and in other shapes. It is attached to both the pedal and the base by insertion at each end in respective apertures by an interference fit. When the opposite end of the pedal is pressed down, the pin is bent and provides the resilient force needed to return the pedal to its normal position when it is released. The angle at which the pin is installed determines the tension on the pedal. The pin tends to keep the pedal laterally positioned as a result of the restoring force produced when the pin is twisted.

At the opposite end of the pedal, a similar, guide pin is attached at one end to the pedal by insertion of the upper end of the pin in an aperture of the pedal with an interference fit. The opposite, lower end of this guide pin fits loosely in an aperture in the base of the pedal board, which sets limits to the lateral movement of the pedal. The lower end of the guide pin also strikes, and actuates, an elastomeric electric switch which closes the electrical circuit for that particular pedal, thereby linking the pedal with the switch. The switch thus acts as a pedal movement detector that produces an electric signal in response to pedal movement. A rubber or felt bumper strip or ring is provided for reducing noise when the pedal is pushed downwardly to its limit; and one or more felt washers is provided in the base aperture to protect the electric switch and reduce noise when extreme lateral movement does occur.

The elastomeric electric switch comprises a bell-shaped elastomeric chamber having a diaphragm at the lower end with a conductive element disposed on the outside of the diaphragm. The diaphragm is positioned over contacts on a supporting circuit board. When the lower end of the guide pin of a pedal pushes downwardly on the bell-shaped portion of the elastomeric electric switch, force transmitted down the wall of the chamber and the increased pressure in the chamber pushes the diaphragm downwardly so that the conductive element shorts the contacts and closes the respective circuit. The bell shape of the switch allows the switch to be compressed in varying amounts by the free end of the guide pin so that the distance of travel of the guide pin is not critical. The elastomeric electric switch is provided with air channels leading from beneath the diaphragm to a surge chamber so that air will not be trapped below the diaphragm and prevent the diaphragm from shorting the contacts.

Therefore, it is a principal objective of the present invention to provide a novel and improved pedal board for a musical instrument.

It is another objective of the present invention to provide a pedal board that facilitates assembly thereof and reduces the number of parts.

It is yet another objective of the present invention to provide a pedal board that is quieter than previously known pedal boards.

It is a further objective of the present invention to provide a pedal board that has a longer useful life than previous known pedal boards.

It is a principal feature of the present invention that it employs a mounting pin to position the pedal in a pedal board, set the pedal tension, limit lateral movement of the pedal, and provide the pedal with resiliency.

It is another feature of the present invention that it employs an elastomeric electric switch to close the electrical circuit for a corresponding pedal wherein the switch allows a relatively wide tolerance in the range of movement of the pedal and provides a relatively long useful life.

It is yet another feature of the present invention that it employs a guide pin for preventing the pedals of a pedal board from moving laterally beyond predetermined limits and for actuating a switch.

It is a further feature of the present invention that the elastomeric electric switch includes a surge chamber to ensure that trapped air will not prevent circuit closure.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
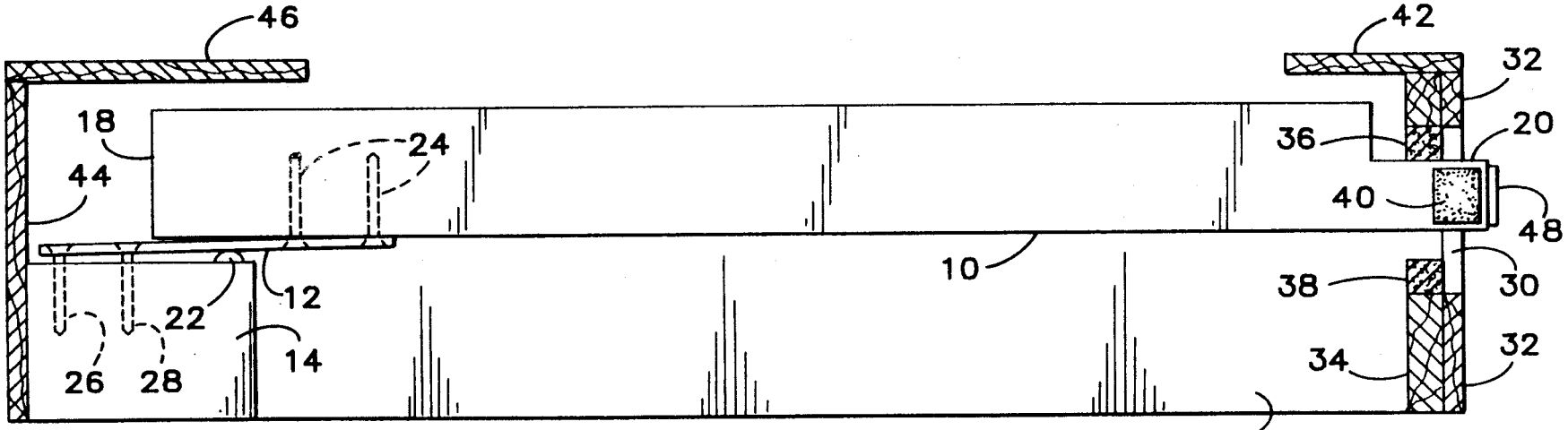
FIG. 1 shows a side view of a typical prior art pedal board with the mounting base thereof in section.

A typical prior art pedal board assembly is shown in FIG. 1. A pedal 10, one of a plurality of pedals, is mounted by a flat metal spring 12 to a spring rail 14. An organ typically has pedals for playing sharps, i.e., pedal sharps, and pedals for playing naturals, i.e., pedal naturals. The pedal shown in FIG. 1 is a sharp pedal. For purposes of this description, the end of the pedal at which it is mounted to the spring rail will be called the back end 18 and the opposite end will be called the front end 20. A fulcrum 22 is also mounted on the spring rail at the back end. The pedal 10 is typically made of wood. Spring 12 is attached to the pedal by a pair of wood screws 24 and to the spring rail by wood screw 26 and wood screw 28. In its normal position, the pedal rests against an upper bumper 36. The tension by which the pedal 10 resists downward force is adjusted by tightening or loosening wood screws 26 and 28.

The front end 20 of the pedal is inserted through a corresponding slot 30 in a comb guide 32, i.e., a wooden sheet with slots in it resembling a comb. The slot limits both the vertical and the horizontal travel of the pedal. The comb guide is attached to a support 34 which also carries the upper bumper 36 and a lower bumper 38. Pieces of felt 40 are attached to respective sides of the pedal 10 to reduce noise when the pedal strikes the inside surfaces of the comb guide defined by the slot 30. A cover or toe board 42 is attached to the support 34. Similarly, rear trim 44 and a heal board 46 are provided at the back end 18 of the pedal. The comb guide, support, toe board, back trim, heal board and spring rail are held in place by two sides 16 (only one shown), all of which are ordinarily made of wood. All or some of the comb guide, support, toe board, back trim, heal board and spring rail are referred to herein collectively as a "base," for convenience. The entire assembly is known as a "pedal board."

The flat metal spring 12 of the prior art pedal board tends to provide inadequate resistance to lateral movement of the pedal 10, requires heat treatment prior to installation, and must be adjusted for proper tension. When the front end 20 of the pedal moves in the slot 30, it often strikes the sides of the slot as well as the upper bumper 36 and lower bumper 38. This causes undesirable noise, despite the presence of the felt pieces 40.

A magnet 48 is placed on the front end 20 of the pedal to actuate a reed switch (not shown) as the pedal moves up and down. Alignment of the magnet 48 with the pedal is often critical and difficult. Mechanical switching devices are also used.

Figure 2A:
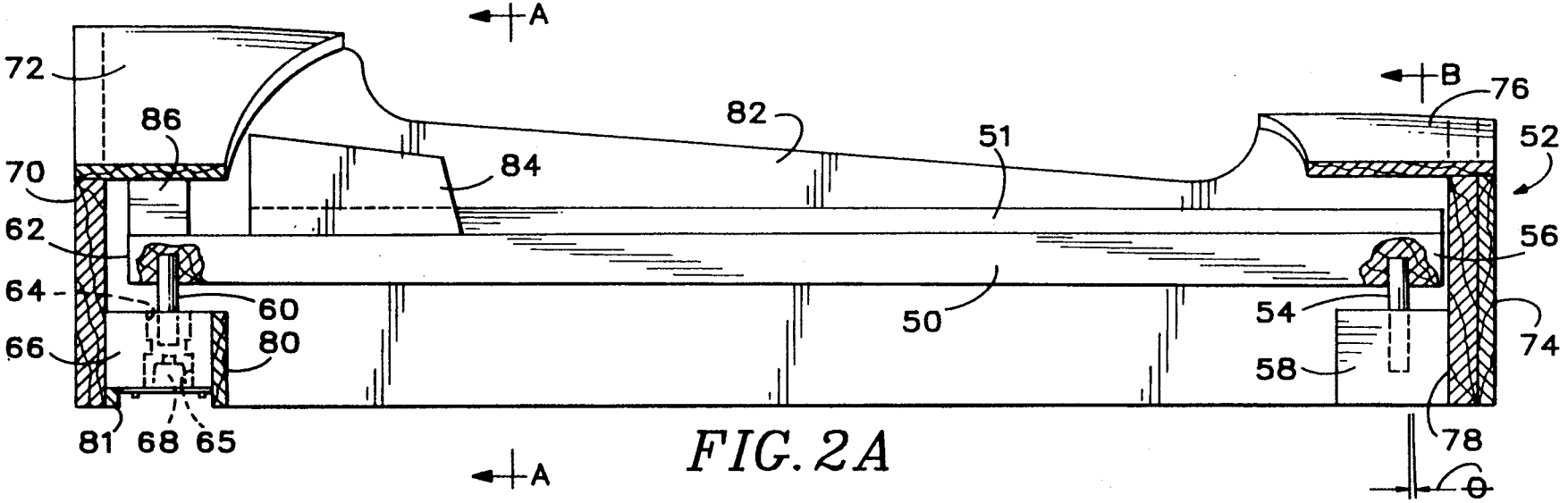
FIG. 2A is a simplified side view of a pedal board according to the present invention, with the pedal board base shown in section, the pedals in their normal positions, and portions of one pedal cut away in section to show mounting and guide pin attachment.

Turning now to FIG. 2A, a pedal board according to the present invention comprises a plurality of pedals, such as sharp pedal 50 mounted at the back 52 of the pedal board by a mounting pin 54 inserted in the back end 56 of the pedal. The upper end of the mounting pin 54 is inserted in an aperture in the pedal 50 by an interference fit and the opposite, lower end of the mounting pin 54 is inserted in an aperture in a spring rail 58 by an interference fit. The interference fit is accomplished by making the outside dimension of the pin 54 slightly greater than the inside dimension of the aperture in which it is placed. Preferably, the pin is cylindrical in shape, and the interference fit is accomplished by making the outside diameter of the pin 54 slightly greater than the inside diameter of the apertures in which it is placed. The interference fit prevents the connection between the pin 54 and the pedal 50, and the pin 54 and the spring rail 58, from slipping. (A natural pedal 51 is shown behind the sharp pedal and is mounted in a like manner.)

FIG. 2A shows the pedal 50 in its normal, upward position. It is held in that position by the resistance of mounting pin 54 to bending. The upper limit of travel of the front end 62 of the pedal 50 is limited by a stop 86. When the pedal is in its normal "up" position the front end 62 rests against the stop. Consequently, the angle $\theta$ at which the pin 54 is mounted in the spring rail determines the tension exhibited by the pedal 50. Typically, the pedals are mounted so as to be preloaded with a tension of 2½ to 3 pounds.

Typically, the pedal 50 is made of wood and, preferably, the pin 54 is made of fiberglass. It has been found that pulltruded fiberglass provides particularly advantageous and consistent results. However, it is to be recognized that the pin 54 may be made of other materials without departing from the principles of this invention.

A guide pin 60 is attached to the pedal 50 at the front end 62 thereof. The guide pin 60 is attached to the pedal 50 by insertion of its upper end in an aperture with an interference fit. The opposite, lower end of the guide pin 60 fits loosely in an aperture 64 in switch assembly block 66. The guide pin 60 both limits the maximum lateral travel of the pedal 50 and actuates an elastomeric electric switch 68 when the pedal 50 is pressed down by the foot of a musician playing the organ.

The pedal board according to the present invention is also provided with front trim 70, a toe board 72 attached to the front trim, back trim 74, and a heal board 76 attached to the back trim. The heal board is strengthened by a back support 78. The switch assembly block 66 is supported by a switch assembly block support 80 and a spacer 81. The stop 86 is attached to the toe board 72. The entire assembly is held together by sides 82 (one side not shown). The pedal board includes both sharp and natural pedals, pedal 50 being a sharp pedal and having an extension 84 attached thereto for receiving pressure from a musician's foot.

Figure 2B:
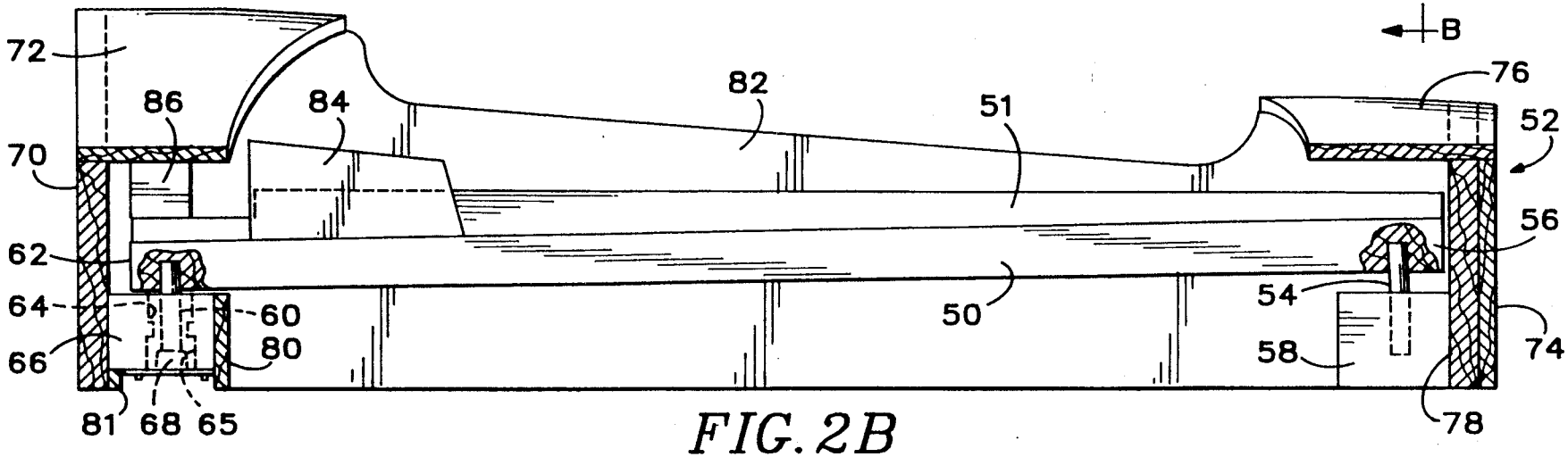
FIG. 2B is a simplified side view of the pedal board of FIG. 2A with one pedal in its depressed position.

FIG. 2B shows the pedal 50 in its depressed position, which it assumes when pushed down by the foot of the musician playing the organ. The resistance of mounting pin 54 provides the tension against which the musician s foot must work, and the resiliency of that pin 54 returns the pedal 50 to its normal position, as in FIG. 2A, when the pressure from the musician's foot is released.

While the aperture 64 in the switch assembly block 66 limits the maximum lateral travel of pedal 50 due to the guide pin 60, it is to be recognized that the guide pin 60 does not ordinarily strike the inner surface of aperture 64, because the resistance of mounting pin 54 is relatively great. Thence, this preferred embodiment of the invention does not encounter the degree of problem encountered by the prior art illustrated in FIG. 1.

Figure 3A:
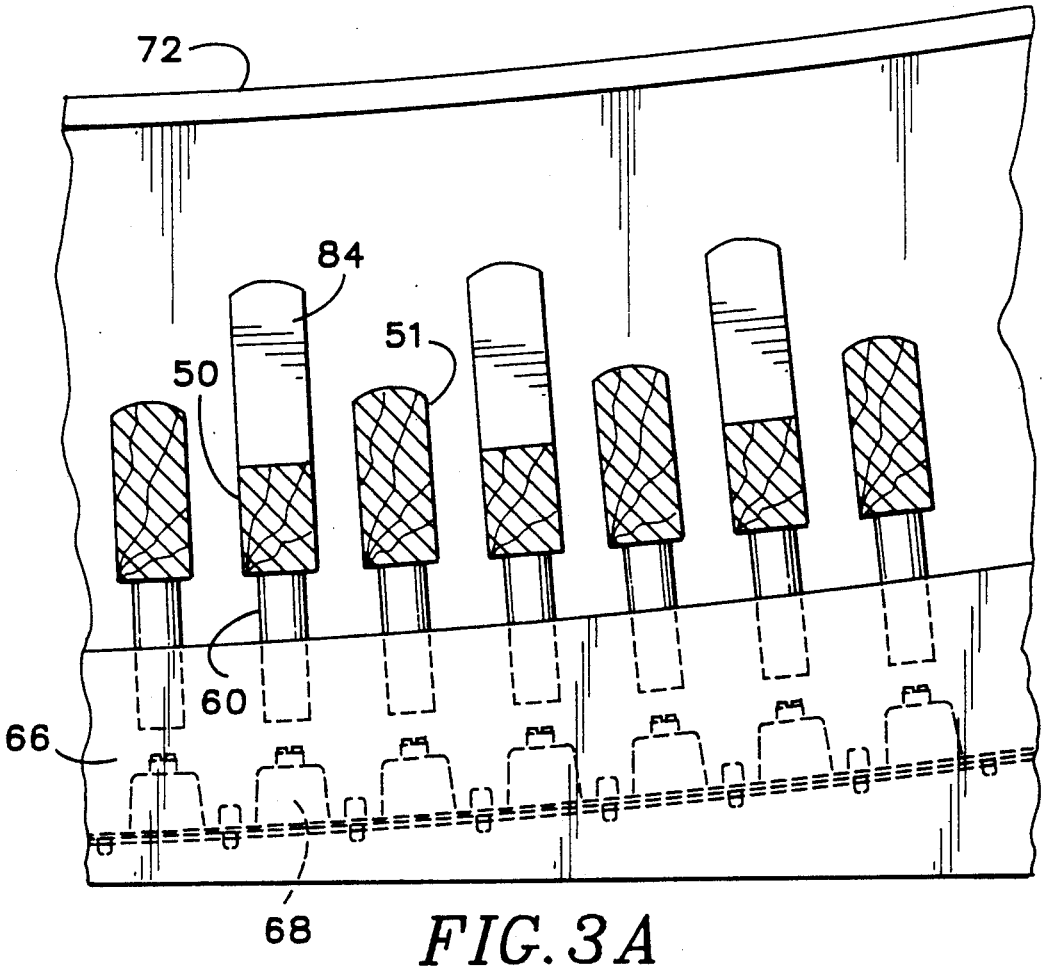
FIG. 3A is a partial section of the pedal board of FIG. 2A taken along line A—A.
Figure 3B:
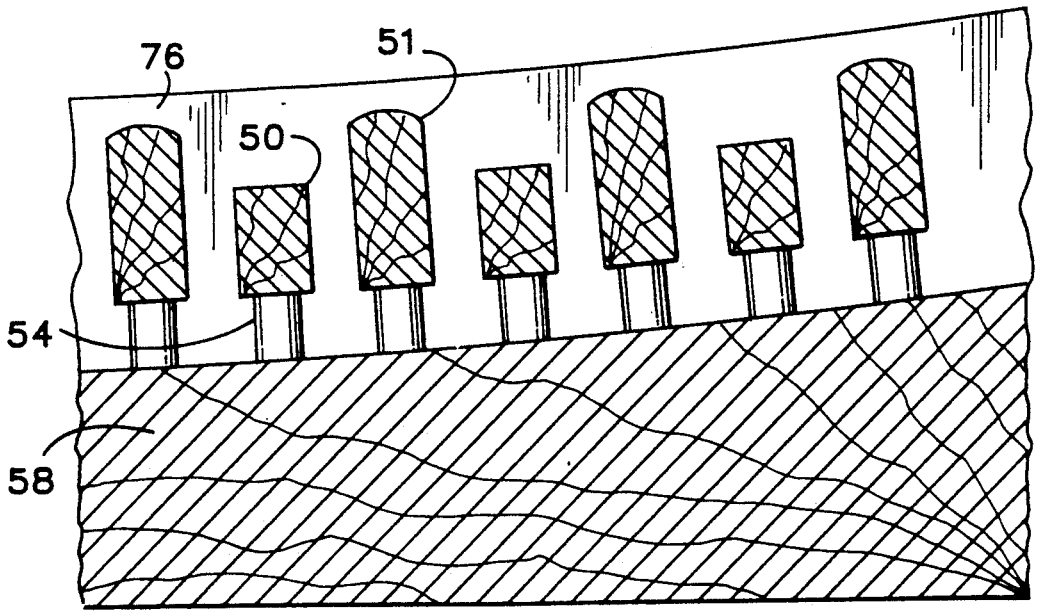
FIG. 3B is a partial section of the pedal board of FIG. 2A taken along line B—B.

FIG. 3A shows an end view of a section of the pedal board of FIG. 2A taken along line A—A of FIG. 2A. As shown, a plurality of pedals 50, and corresponding elastomeric electric switches 68 (only one each of which is shown in FIG. 2A) are disposed adjacent one another. FIG. 3B shows another end view of the pedal board of FIG. 2A taken along line B—B of FIG. 2A. While FIG. 3A shows the front of the pedal board and switching assembly, FIG. 3B shows the back of the pedal board and mounting pins.

Figure 4A:
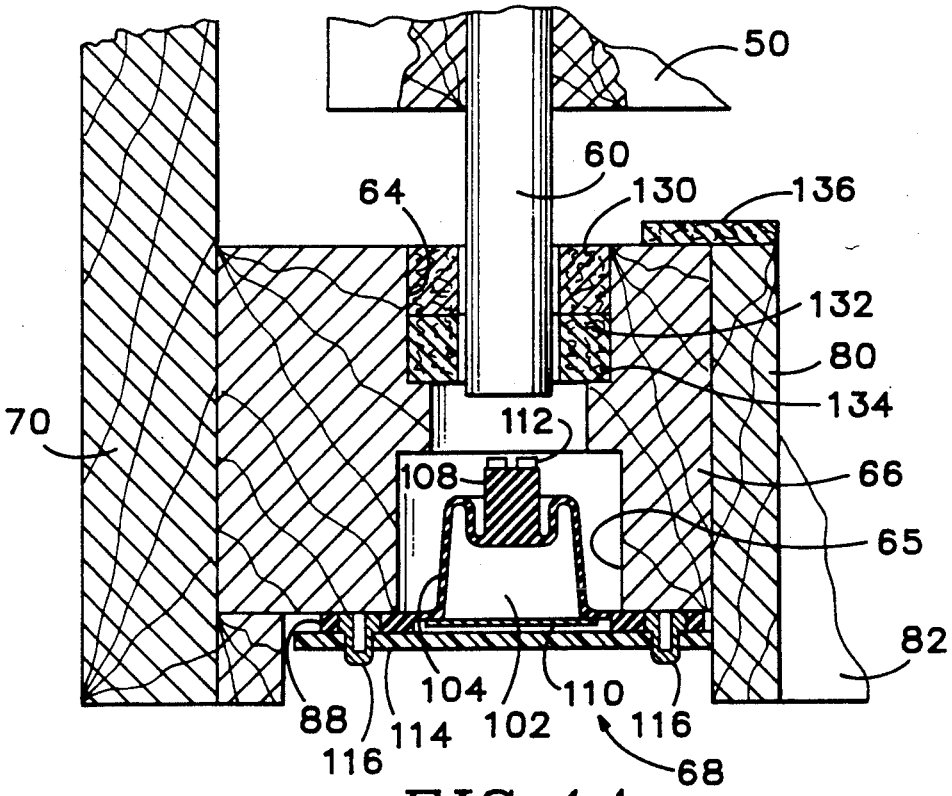
FIG. 4A is a blown-up section of a portion of the pedal board of FIG. 2A showing a guide pin in normal relation to an elastomeric electric switch.
Figure 4B:
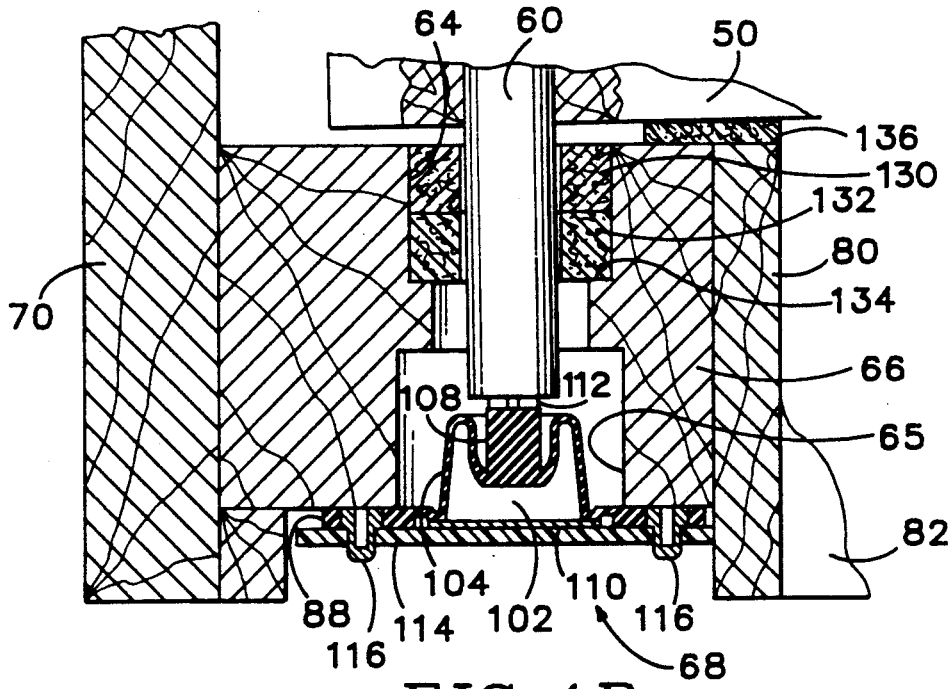
FIG. 4B is a blown-up section of a portion of the pedal board of FIG. 2B showing the guide pin in its depressed position with respect to the elastomeric electric switch.

The relationship of the pedal 50 and guide pin 60 to the elastomeric electric switch 68 is shown more clearly in FIGS. 4A and 4B. In these figures, the switch assembly block is shown in greater detail, albeit with a somewhat simplified illustration of the elastomeric electric switch 68. FIG. 4A corresponds to FIG. 2A, in that the pedal is in its normal, up position, while FIG. 4B corresponds to FIG. 2B in that the pedal 50 is in its depressed, down position.

In FIGS. 4A and 4B, it can be seen that the aperture 64 includes a pair of annular washers 130 and 132 made of felt or equivalent material and stacked on a ledge 134 in the aperture. These washers provide a low friction surface for the guide pin 60 on those occasions when it does bump against the side, and also reduce noise as the result of such bumping. They also tend to prevent foreign material from getting into the chamber 65 where the switch is located, thereby protecting the switch. In addition, a felt or rubber bumper 136 is provided at the top of the switch assembly block 66 so that, when the pedal 50 reaches its downward-most position, as shown in FIG. 4B, it strikes the bumper 136 which cushions the pedal 50 and minimizes noise. It can also be seen in FIG. 4B that, when the guide pin 60 moves downward, it abuts against and compresses the elastomeric electric switch 68. As will be explained hereafter, that causes the switch to close contacts which completes a circuit.

Figure 5:
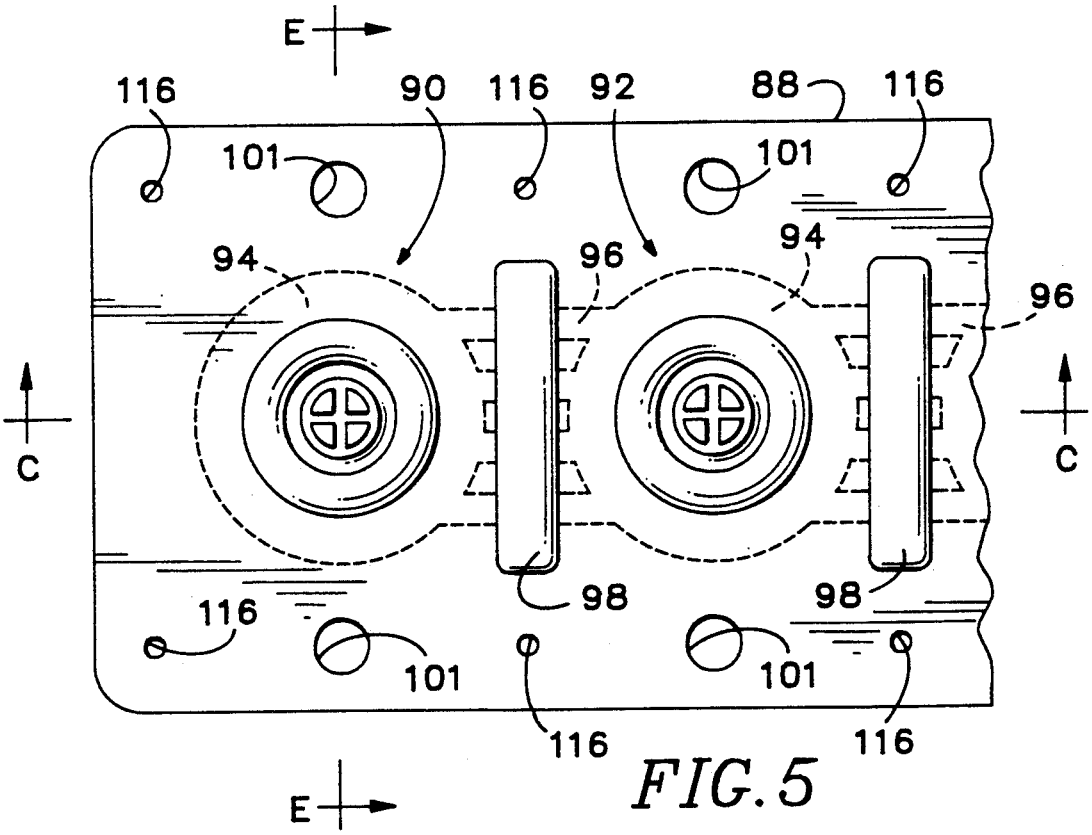
FIG. 5 is a top view of a pair of elastomeric electric switches for respective pedals according to the present invention.

A top view of the elastomeric electric switches is shown in FIG. 5. In this figure, the switches are shown apart from the rest of the pedal board. As a plurality of pedals are used in the pedal board, sets of elastomeric electric switches are assembled into a single strip 88, side by side. Preferably, each set of switches is made of a single assembly, typically having 7, 5, or 3 switches molded out of an elastomeric material such as rubber. FIG. 5 shows a first switch 90 and a second switch 92. The spaces 94 beneath the switches are connected by molded channels 96, which also connect to molded surge chambers 98. This is so that when a switch is depressed, the air beneath it can escape to another switch or surge chamber.

Figures 6, 8:
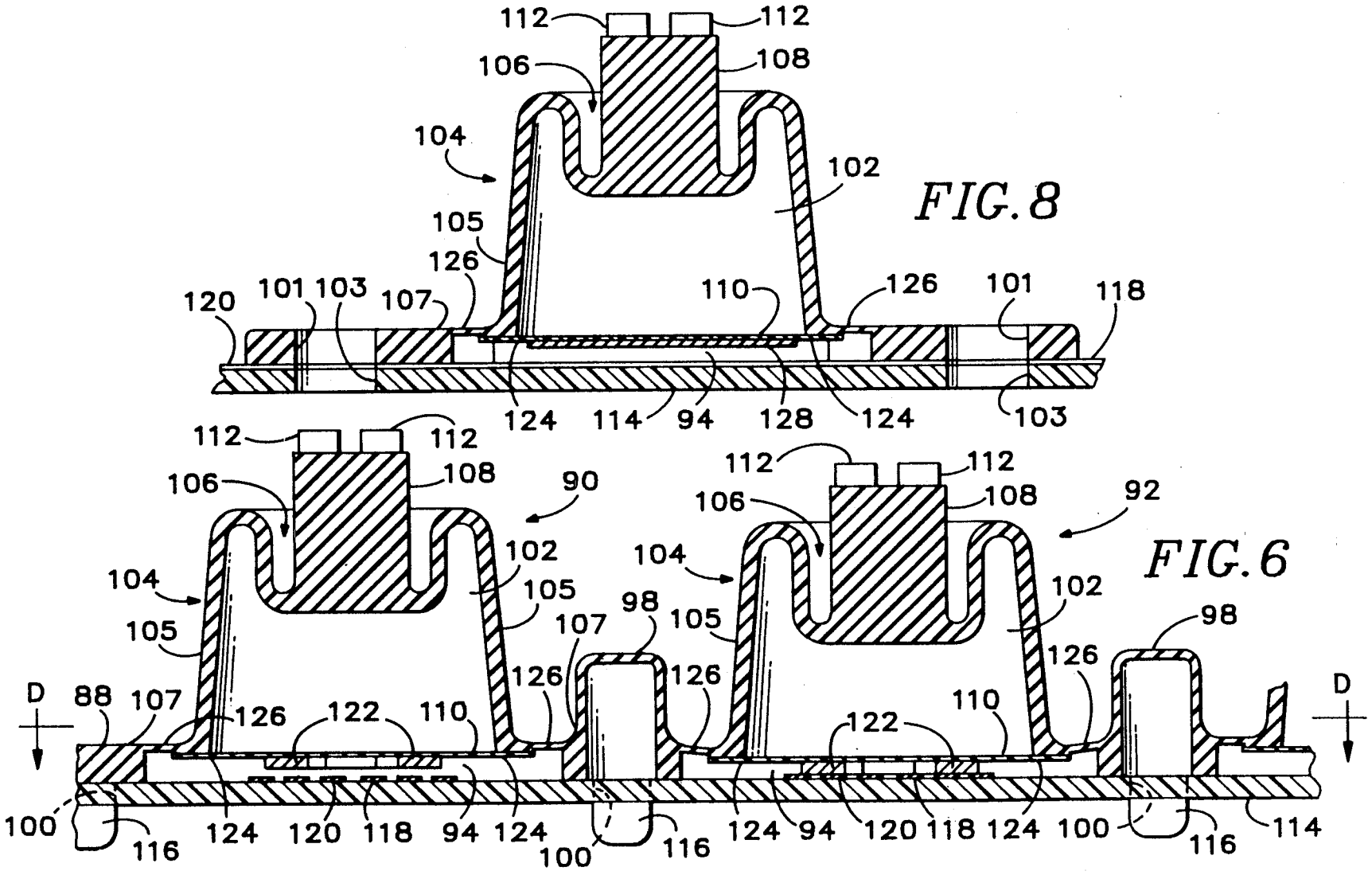
FIG. 6 is a side section of the elastomeric electric switches of FIG. 5 taken along line C—C, and showing one switch in its depressed position.
FIG. 8 is a side section of an alternative elastomeric electric switch according to the present invention.

Turning now to FIG. 6, each of the elastomeric electric switches comprises a chamber 102 having a bell-shaped cover upper wall 104, including a concave portion 106 in which an abutment 108 is disposed, and a diaphragm 110 which closes off the bottom portion of the chamber. Fins 112, having spaces therebetween, are provided at the top of each abutment 108 for receiving the end of the guide pin 60, while allowing air to escape from between the end of the guide pin and the top of the abutment 108. The elastomeric electric switch strip 88 is mounted on printed circuit board 114 of a type commonly known in the art. It is positioned on the circuit board by pins 116 which are placed in guide holes 100 in the circuit board. The resultant assembly is mounted by wood screws (not shown) placed through the holes 101 in the strip 88 as corresponding holes 103 in circuit board 114 (see FIG. 5). However, it is to be recognized that other support structures and mounting mechanisms could be used without departing from the principles of this invention.

Figure 7:
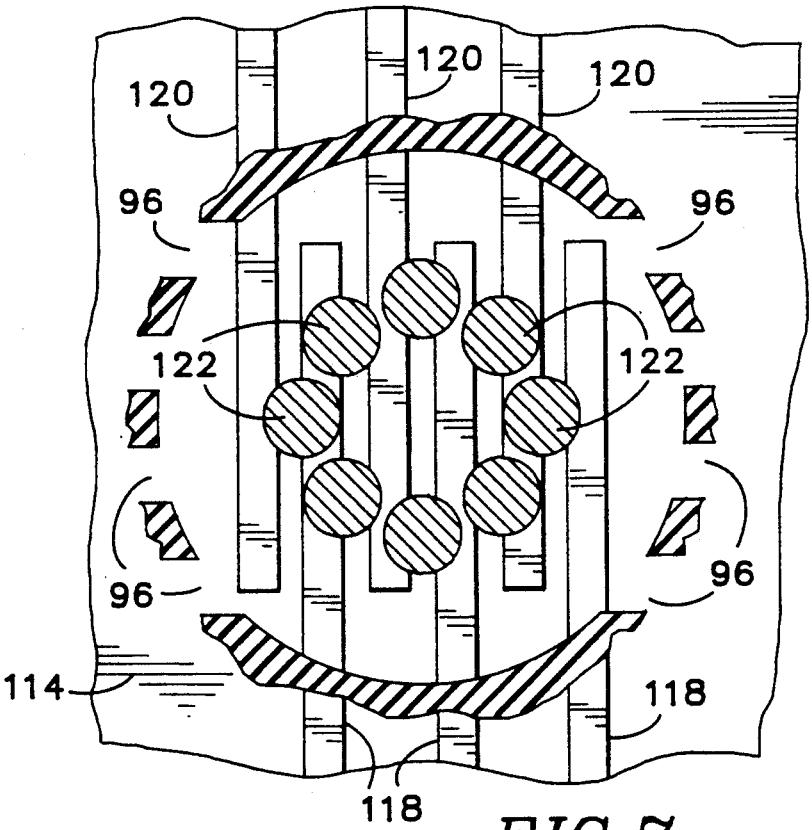
FIG. 7 is a section of one of the switches of FIG. 6 taken along line D—D thereof.

As shown in FIG. 7, the printed circuit board 114 has, printed or etched thereon, contacts 118 and 120, which form the two sides of a switch. When contacts 118 are shorted to contacts 120, a circuit is closed. With reference to both FIGS. 6 and 7, in the preferred embodiment a plurality of circular conductive elements 122, like pucks, preferably made of graphite impregnated rubber ("conductive rubber"), are disposed on the bottom of each diaphragm 110. The conductive elements 122 are placed on the bottom of the diaphragm 110 in a circular pattern. When the diaphragm is pushed downwardly by force around its periphery 124 and increased pressure within the chamber 102, as shown with respect to switch 92 in FIG. 6, the conductive elements 122 are pressed against the contacts 118 and 120, thereby shorting them.

The structure of the elastomeric electric switches permits a relatively wide tolerance in the limit of travel of the guide pin 60. More specifically, each switch has a narrowed, flange portion 126 around the periphery of the wall 104, between a principal portion 105 and a mounting portion 107 of the wall where the wall is attached to the rest of the switch strip 88. As can be seen in FIG. 6, the circuit 114 substantially defines a reference or "base" plane, and the principal portion 105 of the wall makes an angle with the base plane of greater than 45 degrees. Thence, when force is applied to the fins 112 at the top of the abutment 108, the bell-shaped wall 104 both transmits force down to the weaker portions 126 and folds in on itself, increasing the pressure in the chamber 102. The weakened portions bend, moving the diaphragm 124 toward the printed circuit board 114, and the increased pressure in the chamber 102 also pushes the conductive elements 122 firmly against the contacts 118 and 120 on the circuit board 114. Electrical contact is typically made about half way through the range of travel of the guide pin 60. Pushing the abutment downwardly more than is necessary merely increases the pressure within the chamber 102, thereby allowing for a relatively wide tolerance in the final stopping point of the guide pin 60. This simplifies manufacture and assembly of the pedal board.

When the diaphragm 110 is pushed downwardly, the air beneath it in space 94 escapes through channel 96 to another switch or to a surge chamber 98.

An alternative embodiment of elastomeric electric switch is shown in FIG. 8. It is identical to the switches shown in FIG. 6 except that, instead of puck-like conductive elements 122, it employs a layer of conductive material 128 on the bottom of the diaphragm 110. Preferably, this conductive material is a graphite impregnated material pasted on the bottom of the diaphragm. The switch shown in FIG. 8 is shown in section as though it had been taken along line E—E of FIG. 5.

It has been found that elastomeric electric switches are especially advantageous for detecting actuation of a pedal because of their wide tolerance in the detection of movement and their long useful life, and their reliability. It has also been found that combination of interlaced contacts 118 and 120 as shown in FIG. 7, and either conductive rubber puck-like elements 122 or a conductive layer 128 in the bottom of the diaphragm is particularly effective in ensuring electric shorting.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A pedal board for a musical instrument, comprising:

(a) a base for supporting one or more pedals, said base having a front and a back;

(b) at least one pedal, said pedal being an elongate member having a front end adjacent said front of said base and a back end adjacent said back of said base;

(c) detector means associated with said pedal for closing an electric circuit in response to movement of said pedal; and (d) a mounting pin attached to said pedal adjacent said back end thereof and to said base adjacent said back thereof for supporting said pedal on said base such that downward movement of said pedal bends said mounting pin, said mounting pin comprising an elongate member of substantially uniform cross section extending from a position inside said base to a position inside said pedal and serving as the fulcrum for said pedal.

2. The pedal board of claim 1, wherein said uniform cross section of said mounting pin is substantially cylindrical.

3. The pedal board of claim 1, wherein said mounting pin comprises fiberglass material.

4. The pedal board of claim 1, wherein said mounting pin is attached to said pedal and to said base by respective interference fits.

5. A pedal board for a musical instrument, comprising:

(a) a base for supporting one or more pedals, said base having a front and a back;

(b) at least one pedal, said pedal being an elongate member having a front end adjacent said front of said base and a back end adjacent said back of said base;

(c) detector means associated with said pedal for closing an electric circuit in response to movement of said pedal;

(d) a mounting pin attached to said pedal adjacent said back end thereof and to said base adjacent said back thereof for supporting said pedal on said base such that downward movement of said pedal bends said mounting pin; and (e) a guide pin attached to said pedal so as to extend downwardly, said guide pin being disposed in an aperture in said base for preventing excessive lateral movement of said pedal.

6. The pedal board of claim 5, further comprising a cushion disposed between said base and said pedal.

7. The pedal board of claim 5, further comprising an insert disposed within said aperture at least partially between the outer surface of said guide pin and the inner surface of said aperture.

8. The pedal board of claim 1, wherein said means for closing an electric circuit in response to movement of said pedal comprises an elastomeric electric switch and linking means for actuating said elastomeric electric switch in response to downward movement of said pedal.

9. The pedal board of claim 5, wherein said linking means comprises a guide pin attached to said pedal so that when said pedal moves downwardly, said guide pin actuates said elastomeric electric switch.

10. A pedal board for a musical instrument, comprising:

(a) a base for supporting one or more pedals, said base having a front and a back;

(b) at least one pedal, said pedal being an elongate member having a front end adjacent said front of said base and a back end adjacent said back of said base;

(c) an elastomeric electric switch and a guide pin attached to said pedal so that when said pedal moves downwardly, said guide pin actuates said elastomeric electric switch to close an electric circuit in response to movement of said pedal, said guide pin comprising a cylindrical element made of fiberglass and attached by an interference fit to said pedal; and (d) a mounting pin attached to said pedal adjacent said back end thereof and to said base adjacent said back thereof for supporting said pedal on said base such that downward movement of said pedal bends said mounting pin.

11. A pedal board for a musical instrument, comprising:

(a) a base for supporting one or more pedals, said base having a front and a back;

(b) at least one pedal, said pedal being an elongate member having a front end adjacent said front of said base and a back end adjacent said back of said base;

(c) an elastomeric electric switch for closing an electric circuit in response to movement of said pedal, said elastomeric electric switch comprising a pair of contacts that conduct an electric current when shorted, an elastomeric diaphragm disposed adjacent said contracts for shorting said contacts when said diaphragm touches said contacts, and an elastomeric wall forming a chamber over said diaphragm such that when said elastomeric wall is compressed, said diaphragm is forced against said touches said contacts;

(d) a guide pin attached to said pedal so that when said pedal moves downwardly, said guide pin actuates said elastomeric electric switch; and (e) a mounting pin attached to said pedal adjacent said back end thereof and to said base adjacent said back thereof for supporting said pedal on said base such that downward movement of said pedal bends said mounting pin.

12. The pedal board of claim 11, wherein said elastomeric wall comprises a substantially bell-shaped member.

13. The pedal board of claim 11, wherein said elastomeric diaphragm includes a conductive rubber element attached thereto above said contacts such that when said diaphragm is forced toward said contacts, said conductive element touches and shorts said contacts.

14. The pedal board of claim 11, wherein said contacts are disposed on a printed circuit board, said elastomeric diaphragm and said elastomeric wall being supported by said printed circuit board.

15. The pedal board of claim 14, wherein said elastomeric wall includes a principal portion, a mounting portion, and a flange portion disposed between said principal portion and said mounting portion, said flange portion being weaker than said principal portion.

16. The pedal board of claim 15, wherein said elastomeric wall includes a concave portion disposed opposite said elastomeric diaphragm, said concave portion having an abutment disposed therein and extending out of said concave portion for receiving force from said guide pin.

17. The pedal board of claim 16, wherein said abutment includes fins thereon separated from one another for allowing air between said guide pin and said abutment to escape when said guide pin is forced against said abutment, said fins being disposed between said second pin and said abutment.

18. An elastomeric electric switch, comprising:

(a) a pair of contacts that conduct an electric current when shorted, said contacts being substantially disposed on a base plane;

(b) shorting means disposed adjacent, but ordinarily separated from, said pair of contacts for shorting said contacts in response to downward pressure on said shorting means; and (c) an elastomeric wall forming a chamber over said shorting means such that when downward force is exerted on said chamber, said shorting means is forced against and touches said contacts, said wall having a principal portion, a top portion, a mounting portion and a flange portion disposed between said principal portion and said mounting portion, said flange portion being weaker than said principal portion and said principal portion forming an angle with said base plane greater than 45 degrees.

19. The switch of claim 18 wherein said elastomeric wall comprises a substantially bell-shaped member.

20. The switch of claim 18, wherein said shorting means comprises an said elastomeric diaphragm having a conductive element attached thereto adjacent said contacts such that when said diaphragm is forced against said contacts, said conductive element shorts said contacts.

21. The switch of claim 18, wherein said contacts are disposed on a printed circuit board, said wall being supported by said printed circuit board.

22. The switch of claim 18, wherein said wall includes an abutment disposed on said top portion for receiving compressing force.

23. An elastomeric electric switch, comprising:

(a) a pair of contacts that conduct an electric current when shorted;

(b) an elastomeric diaphragm disposed adjacent said contacts for shorting said contacts when said diaphragm touches said contacts; and (c) an elastomeric wall forming a chamber over said diaphragm such that when said elastomeric wall is compressed, said diaphragm is forced against and touches said contacts, said wall having a principal portion, a top portion, a mounting portion, a flange portion disposed between said principal portion and said mounting portion, said flange portion being weaker than said principal portion, and an abutment disposed on the top of said chamber and extending upwardly therefrom for receiving compressive force, said abutment including fins thereon separated from one another for allowing air between said fins to escape when force is applied to said abutment.

24. An elastomeric electric switch, comprising:

(a) a pair of contacts that conduct an electric current when shorted;

(b) shorting means disposed adjacent, but ordinarily separated from, said pair of contacts in response to downward force on said shorting means;

(c) an elastomeric electric wall forming a first chamber over said shorting means such that when downward force is exerted on said wall, said shorting means is caused to short said pair of contacts; and (d) a second chamber connected to space beneath said first chamber for permitting air to escape from beneath said first chamber into said second chamber.

25. An elastomeric electric switch, comprising:

(a) a pair of contacts that conduct an electric current when shorted, said contacts being substantially disposed on a base plane;

(b) shorting means disposed adjacent, but ordinarily separated from, said pair of contacts for shorting said contacts in response to downward pressure on said shorting means; and (c) an elastomeric wall forming a chamber over said shorting means such that when downward force is exerted on said chamber, said shorting means is forced against and touches said contacts, said wall having a principal portion and a top portion, said principal portion being substantially straight and forming an angle with said base plane greater than 45 degrees, and said top portion having a radical portion connected to said principal portion so as to form a smooth bend inward toward the center of said chamber from said principal portion, said radial portion having a wall thickness substantially the same as the wall thickness of said principal portion.

26. The switch of claim 25 further comprising an abutment disposed at the center of said top portion an extending upwardly therefrom for receiving compressive force.

* * * * *

UNITED STATES PATENT AND TRADEMARK OFFICE

CERTIFICATE OF CORRECTION

PATENT NO. : 5,091,613

DATED : February 25, 1992

INVENTOR(S) : Rohde et al.

It is certified that error appears in the above-identified patent and that said Letters Patent is hereby corrected as shown below:

Col. 8, Line 20, change "5" to --8--.

Col. 9, Line 53, after "18" add --,--.

Col. 10, Line 53, rewrite "radical" as --radial--.

Signed and Sealed this

Twenty-first Day of February, 1995

*Attest:*

*Attesting Officer*

BRUCE LEHMAN

*Commissioner of Patents and Trademarks*